US008195059B2

(12) United States Patent
Shinshi

(10) Patent No.: US 8,195,059 B2
(45) Date of Patent: Jun. 5, 2012

(54) FIXING DEVICE AND IMAGE FORMING APPARATUS USING THE SAME

(75) Inventor: Akira Shinshi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/310,055

(22) Filed: Dec. 2, 2011

(65) Prior Publication Data

US 2012/0070175 A1 Mar. 22, 2012

Related U.S. Application Data

(63) Continuation of application No. 12/929,890, filed on Feb. 23, 2011, now Pat. No. 8,095,030, which is a continuation of application No. 12/000,969, filed on Dec. 19, 2007, now Pat. No. 7,899,350.

(30) Foreign Application Priority Data

Dec. 20, 2006 (JP) ..... 2006-342001

(51) Int. Cl.
*G03G 15/20* (2006.01)

(52) U.S. Cl. ..... 399/69

(58) Field of Classification Search ..... 399/67, 399/69, 70, 328, 330, 335
See application file for complete search history.

(56) References Cited

U.S. PATENT DOCUMENTS 6,118,955 A 9/2000 Yoneda et al.
6,647,221 B1 11/2003 Furuyama
6,882,820 B2 4/2005 Shinshi et al.
7,127,204 B2 10/2006 Satoh et al.
7,239,838 B2 7/2007 Sato et al.
7,242,897 B2 7/2007 Satoh et al.
2005/0271408 A1 12/2005 Hayashi
2006/0002737 A1 1/2006 Shinshi
2006/0165429 A1 7/2006 Satoh et al.
2007/0003334 A1 1/2007 Shinshi et al.
2007/0014603 A1 1/2007 Satoh et al.
2007/0059003 A1 3/2007 Shinshi et al.
2007/0059071 A1 3/2007 Shinshi et al.
2007/0110464 A1 5/2007 Nakayama et al.
2007/0166085 A1 7/2007 Shinshi
2009/0123170 A1 5/2009 Tatematsu et al.

FOREIGN PATENT DOCUMENTS

CN 1501198 6/2004

(Continued)

OTHER PUBLICATIONS

Communication dated Aug. 19, 2001 issued by the Japanese Patent Office for Japanese Patent Application No. 2006-342001.

(Continued)

*Primary Examiner* — David Porta
*Assistant Examiner* — Marcus Taningco
(74) *Attorney, Agent, or Firm* — Harness, Dickey & Pierce, P.L.C.

(57) ABSTRACT

A fixing device including a fixing member to melt a toner so as to fix a toner image onto a recording medium, a temperature sensor to detect a temperature of the fixing member, and a heater to heat the fixing member based on the temperature detected by the temperature sensor. A driving speed of the fixing member is reduced after printing is completed, and subsequently the fixing member stops driving. The fixing member is controlled to have a desired temperature (Ts) after the fixing member stops driving that is lower than a desired temperature (Tp) during printing.

19 Claims, 5 Drawing Sheets

FOREIGN PATENT DOCUMENTS

| | | |
|---|---|---|
| JP | 06-202526 | 7/1994 |
| JP | 2002-049272 | 2/2002 |
| JP | 2002-108130 | 4/2002 |
| JP | 2004-212769 | 7/2004 |
| JP | 2005-037446 | 2/2005 |
| WO | WO 2006/095782 | 9/2006 |

OTHER PUBLICATIONS

Communication issued by the Japanese Patent Office dated Feb. 24, 2012 for Japanese Application No. 2006-342001.

FIXING DEVICE AND IMAGE FORMING APPARATUS USING THE SAME

PRIORITY STATEMENT

The present patent application is a continuation of and claims priority under 35 U.S.C. §120 U.S. on application Ser. No. 12/929,890, filed Feb. 23, 2011 now U.S. Pat. No. 8,095,030, which is a continuation of and claims priority under 35 U.S.C. §120 U.S. on application Ser. No. 12/000,969, filed Dec. 19, 2007 now U.S. Pat. No. 7,899,350, which claims priority under 35 U.S.C. §119 from Japanese Patent Application No. 2006-342001 filed on Dec. 20, 2006 in the Japan Patent Office, the entire contents each of which are hereby incorporated herein by reference.

BACKGROUND

1. Field

Example embodiments generally relate to an image forming apparatus using an electrophotographic method, such as a copying machine, a printer, a facsimile machine, and a multifunction apparatus that combines the functions of the copying machine, the printer, and the facsimile machine, and a fixing device installed in the image forming apparatus, for example, a fixing device using a belt fixing system including a fixing belt.

2. Description of the Related Art

A related-art image forming apparatus, such as a copying machine, a facsimile machine, a printer, or a multifunction printer having two or more of copying, printing, scanning, and facsimile functions, forms a toner image on a recording medium (e.g., a sheet) according to image data using an electrophotographic method. In such a method, for example, a charger charges a surface of an image carrier (e.g., a photoconductor). An optical device emits a light beam onto the charged surface of the photoconductor to form an electrostatic latent image on the photoconductor according to the image data. The electrostatic latent image is developed with a developer (e.g., a toner) to form a toner image on the photoconductor. A transfer device transfers the toner image formed on the photoconductor onto a sheet. A fixing device applies heat and pressure to the sheet bearing the toner image to fix the toner image onto the sheet. The sheet bearing the fixed toner image is then discharged from the image forming apparatus.

In related-art image forming apparatuses, a fixing device using a belt fixing system, which includes a fixing belt serving as a fixing member, is widely used. In one example, the fixing device includes a heat roller in which a heater is provided, a fixing belt tightly stretched across a plurality of rollers such as the heat roller, a pressing roller for pressing against the heat roller via the fixing belt to form a nip portion, and so forth. A recording medium is conveyed through the nip portion formed between the fixing belt and the pressing roller, so that a toner image is fixed onto the recording medium. Since the fixing device using the belt fixing system includes the fixing member with a lower heat capacity as compared to a fixing member included in a fixing device using a roller fixing system, a rise time of the fixing device can be shortened, resulting in greater printing efficiency. However, one problem with such an arrangement is that a temperature overshoot in the fixing member may occur after printing has been completed.

A temperature overshoot occurs because the fixing belt has a small heat capacity, and therefore a portion thereof heated by the heat roller has the highest temperature whereas temperatures of other portions thereof easily decrease. Specifically, the fixing belt has a temperature distribution in a circumferential direction in which the portion heated by the heat roller has the highest temperature, giving rise to a relatively large temperature difference between an inner circumferential surface of the heat roller facing the heater and a surface of the fixing belt. The foregoing temperature distribution becomes more pronounced and the temperature difference increases further the longer printing continues.

When driving of the fixing belt is stopped after printing has been completed, the fixing device enters a standby state to keep the temperature thereof lower than that during printing. Under such temperature distribution conditions with its large temperature differences, the heat of the heat roller is transferred to the fixing belt to maintain heat balance. Moreover, the heater is turned on whenever the temperature of the fixing belt is lower than a desired temperature while the fixing belt is stopped. As a result, heat from the heater is further added to the fixing belt, so that the temperature of the fixing belt becomes considerably higher than the desired temperature during standby, causing temperature overshoot.

There is an additional concern, insofar as components of the fixing device are repeatedly heated at a higher temperature due to such temperature overshoot, and consequently secondary problems, such as deterioration of a rubber layer included in the fixing belt and a fixing auxiliary roller, detachment of an adhesive layer included in rollers having a plurality of layers, metal fatigue of the heat roller, and so forth, may occur.

One possible method of solving the above-described problems is to idle the fixing belt after printing has been completed. However, when the fixing belt is idled at a higher speed, the temperature distribution and the temperature difference described above may be aggravated due to a further release of the heat from the fixing belt.

Another example of a fixing device is proposed in which a driving speed of a fixing belt is changed based on toner type and toner image resolution. However, the object of such a fixing device is to obtain a preferred fixing performance, and not to solve the above-described problems.

Yet another example of a fixing device using a temperature control method is proposed in which, by using a contactless temperature sensor, a desired temperature is changed at predetermined intervals so that temperature overshoot or undershoot relative to the desired temperature can be reduced. However, one drawback of such a fixing device employing the contactless temperature sensor is that temperature readings sometimes lack the precision in a short time required for high-speed image formation. The object of such a fixing device is to solve problems specific to the fixing device using the contactless temperature sensor.

SUMMARY

At least one embodiment provides a fixing device including a fixing member to melt a toner so as to fix a toner image onto a recording medium, a temperature sensor to detect a temperature of the fixing member, and a heater to heat the fixing member based on the temperature detected by the temperature sensor. A driving speed of the fixing member is reduced after printing is completed, and subsequently the fixing member stops driving. The fixing member is controlled to have a desired temperature (Ts) after the fixing member stops driving that is lower than a desired temperature (Tp) during printing.

At least one embodiment provides an image forming apparatus including an image bearing member to bear an electrostatic latent image, a charging device to charge a surface of the image bearing member, an irradiating device to irradiate the charged surface of the image bearing member to form an electrostatic latent image thereon, a developing device to develop the electrostatic latent image with a toner to form a toner image, a transfer device to transfer the toner image onto a recording medium, and the fixing device that is described above.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
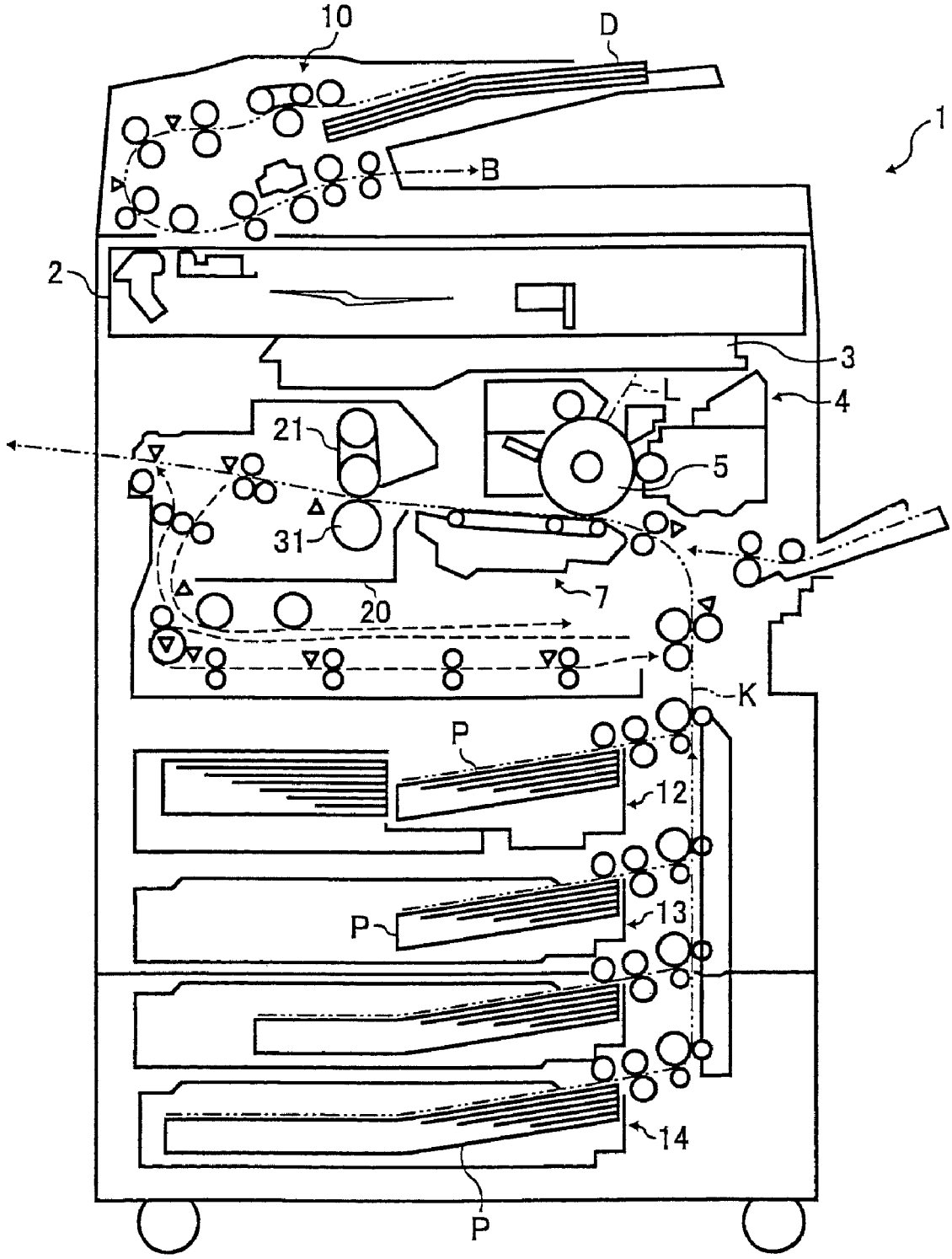
FIG. 1 is an overall schematic view illustrating a structure and operations of an image forming apparatus according to example embodiments.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of example embodiments.

The terminology used herein is for the purpose of describing example embodiments only and is not intended to be limiting. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner. Reference is now made to the drawings, wherein like reference numerals designate identical or corresponding parts throughout the several views.

FIG. 1 is an overall schematic view illustrating a structure and operations of an image forming apparatus according to example embodiments. Reference numeral 1 denotes an image forming apparatus. Reference numeral 2 denotes an original document reading unit to optically read image information of an original document D. Reference numeral 3 denotes an exposure unit to irradiate exposure light L to a photoconductive drum 5 based on the image information optically read by the original document reading unit 2. Reference numeral 4 denotes an image forming unit to form a toner image on the photoconductive drum 5. Reference numeral 7 denotes a transfer unit to transfer the toner image formed on the photoconductive drum 5 onto a recording medium P. Reference numeral 10 denotes an original document conveyance unit to convey the original document D set on an original document stand to the original document reading unit 2. Reference numerals 12 to 14 denote paper feed trays in which the recording medium P such as a transfer sheet is stored. Reference numeral 20 denotes a fixing device to fix an unfixed toner image onto the recording medium P. Reference numeral 21 denotes a fixing belt serving as a fixing member provided in the fixing device 20. Reference numeral 31 denotes a pressing roller serving as a pressing member provided in the fixing device 20.

A normal printing performed by the image forming apparatus 1 is described below with reference to FIG. 1.

The original document D is conveyed from the original document stand by conveyance rollers provided in the original document conveyance unit 10 in a direction indicated by an arrow B in FIG. 1, and passes over the original document reading unit 2. At the time, the original document reading unit 2 optically reads image information of the original document D passing thereover. The image information optically read by the original document reading unit 2 is converted into an electrical signal, and the electrical signal is sent to the exposure unit 3. The exposure unit 3 directs the exposure light L such as a laser beam onto the photoconductive drum 5 in the image forming unit 4 based on the electrical signal. Meanwhile, in the image forming unit 4, the photoconductive drum 5 is rotated in a clockwise direction in FIG. 1, and a toner image corresponding to the image information is formed on the photoconductive drum 5 through charging, exposing, and developing processes. Thereafter, the transfer unit 7 transfers the toner image formed on the photoconductive drum 5 onto the recording medium P conveyed by registration rollers.

Meanwhile, the recording medium P to be conveyed to the transfer unit 7 is fed from a paper feed tray automatically or manually selected from the paper feed trays 12, 13, and 14. Here, for example, it is assumed that the paper feed tray 12, which is placed in the topmost level, is selected to feed the recording medium P. One sheet of the recording medium P placed on the top thereof stored in the paper feed tray 12 is conveyed to a conveyance path K. The recording medium P passes through the conveyance path K and reaches the registration rollers. Thereafter, the recording medium P is conveyed to the transfer unit 7 in synchronization with the image formed on the photoconductive drum 5, so that a position of the image is correctly aligned with that of the recording medium P.

After passing the transfer unit 7, the recording medium P having the transferred image thereon is conveyed to the fixing device 20 through the conveyance path K. In the fixing device 20, the recording medium P is conveyed through a nip portion between the fixing belt 21 and the pressing roller 31, so that the transferred image thereon is fixed onto the recording medium P by heat applied from the fixing belt 21 and pressure applied from both the fixing belt 21 and the pressing roller 31. The recording medium P having the fixed image thereon is conveyed out of the nip portion between the fixing belt 21 and the pressing roller 31, and is discharged from the image forming apparatus 1. Thus, a series of image forming processes is completed.

Figure 2:
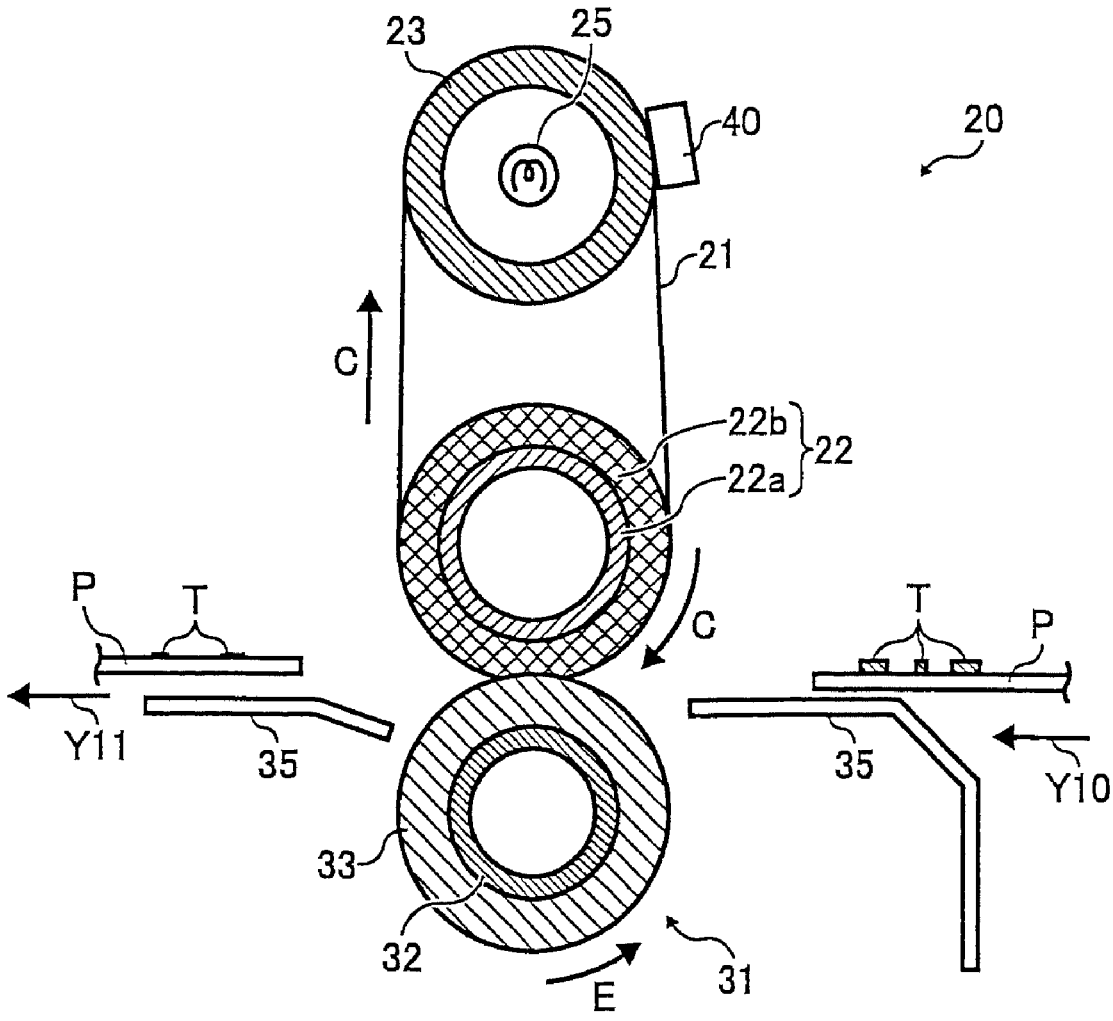
FIG. 2 is an enlarged schematic view illustrating a structure and operations of a fixing device installed in the image forming apparatus shown in FIG. 1.

FIG. 2 is an enlarged schematic view illustrating a structure and operations of the fixing device 20 disposed in the image forming apparatus 1. As shown in FIG. 2, the fixing device 20 includes the fixing belt 21, a fixing auxiliary roller 22, a heat roller 23, the pressing roller 31, a temperature sensor 40, guide plates 35, and so forth.

The fixing belt 21 is a seamless belt having a plurality of layers, in which an elastic layer and a releasing layer are sequentially superimposed on a base layer including a resin. The elastic layer in the fixing belt 21 includes an elastic material, such as fluorine-containing rubber, silicone rubber, or expandable silicone rubber. The releasing layer in the fixing belt 21 includes a PFA (a tetrafluoroethylene perfluoroalkyl vinyl ether copolymer resin), a polyimide, a polyetherimide, a PES (a polyether sulfide), and so forth. The releasing layer on a surface of the fixing belt 21 gives a toner image T a releasing property. The fixing belt 21 is tightly stretched across the fixing auxiliary roller 22 and the heat roller 23, and is driven in a direction indicated by arrows C in FIG. 2. A lower heat capacity of the fixing belt 21 improves a rate of temperature increase in the fixing device 20.

The fixing auxiliary roller 22 includes a metal core 22*a* including SUS 304 or the like, and an elastic layer 22*b* including fluorine-containing rubber, silicone rubber, expandable silicone rubber, or the like, formed on the metal core 22*a*. The fixing auxiliary roller 22 contacts the pressing roller 31 with the fixing belt 21 therebetween to form the nip portion. Both edges of an axis of the fixing auxiliary roller 22 are rotatably fixed to side walls of the fixing device 20 via bearings. The fixing auxiliary roller 22 is rotated by a driving unit in a clockwise direction in FIG. 2. The driving unit according to the first example embodiment is configured such that a rotation speed of the fixing auxiliary roller 22 can be changed. Specifically, the driving unit according to the first example embodiment can change a driving speed of the fixing belt 21, the fixing auxiliary roller 22, the heat roller 23, and the pressing roller 31.

The heat roller 23 is a thin cylindrical body including a metallic material such as aluminum or iron. A heater 25 is provided inside the heat roller 23. The heater 25 in the heat roller 23 may be a halogen heater, a carbon heater, or the like, and both edges of the heater 25 are fixedly mounted on the side walls of the fixing device 20. The heat roller 23 is heated by radiant heat from the heater 25, output of which is controlled by an AC power source, not shown, in the image forming apparatus 1. Consequently, the surface of the fixing belt 21 heated by the heat roller 23 applies heat to the toner image T on the recording medium P.

The output of the heater 25 is controlled by the AC power source based on a surface temperature of the fixing belt 21 detected by the temperature sensor 40 provided facing the surface of the fixing belt 21. Specifically, an alternating current is applied to the heater 25 for a time set based on the surface temperature of the fixing belt 21 detected by the temperature sensor 40.

Since the output of the heater 25 is controlled as described above, the surface temperature of the fixing belt 21 can be adjusted to a desired temperature for a fixing operation.

It should be noted that although a contact-type thermistor is used as the temperature sensor 40 in the first example embodiment described above, alternatively a contactless-type thermopile may be used as the temperature sensor 40.

The pressing roller 31 mainly includes a metal core 32 and an elastic layer 33 formed on an outer circumferential surface of the metal core 32 via an adhesive layer. The elastic layer 33 may be a material such as fluorine-containing rubber, silicone rubber, or expandable silicone rubber. A thin releasing layer including a PFA or the like may be provided on the elastic layer 33. The pressing roller 31 is pressed against the fixing auxiliary roller 22 via the fixing belt 21 by a pressing mechanism, not shown. Consequently, the nip portion is preferably formed between the pressing roller 31 and the fixing belt 21.

It should be noted that the heater may be provided inside the pressing roller 31 in order to shorten a rise time of the fixing device 20.

The guide plates 35 to guide the recording medium P are provided at an entry and an exit of the nip portion formed between the fixing belt 21 and the pressing roller 31, respectively. Each of the guide plates 35 is fixed to the side walls of the fixing device 20. A separation plate, not shown, is provided facing the surface of the fixing belt 21 in the vicinity of the exit of the nip portion. The separation plate prevents the recording medium P from attaching to the fixing belt 21 along the conveyance thereof after the fixing operation.

Operations performed by the fixing device 20 with the above-described structure are described in detail below.

When a power source of the image forming apparatus 1 is turned on, the AC power source applies an alternating voltage to the heater 25, and the fixing auxiliary roller 22 and the heat roller 23 are rotated at a normal driving speed so that the fixing belt 21 is driven in the direction indicated by the arrow C in FIG. 2. The pressing roller 31 is also rotated at a normal driving speed in a direction indicated by an arrow E in FIG. 2. At this time, the fixing device 20 is in a warm-up state.

When a control unit receives a print request, printing is started. Specifically, the recording medium P is supplied from any one of the paper feed trays 12 to 14, and a toner image formed by the image forming unit 4 is transferred onto the recording medium P. The recording medium P bearing an unfixed toner image T is conveyed in a direction indicated by an arrow Y10 in FIG. 2 and passes through the nip portion between the fixing belt 21 and the pressing roller 31 pressed against the fixing auxiliary roller 22 via the fixing belt 21. The heat from the fixing belt 21, and the pressure from both the fixing auxiliary roller 22 via the fixing belt 21 and the pressing roller 31, are applied to the recording medium P so that the toner image T is fixed onto the recording medium P. Thereafter, the recording medium P is conveyed out of the nip portion by the driving of the fixing belt 21 and the pressing roller 31, and is further conveyed in a direction indicated by an arrow Y11 in FIG. 2.

When printing is completed, the fixing device 20 enters a standby state, and prepares for the next printing. Specifically, the output of the heater 25 is controlled by the AC power source based on a surface temperature of the fixing belt 21 detected by the temperature sensor 40, such that the surface temperature of the fixing belt 21 is adjusted to a desired temperature during standby, for example, 150° C., which desired temperature is set lower than a desired temperature during printing, for example, 160° C.

A control operation according to the first example embodiment performed by the fixing device 20 is described below with reference to FIG. 3.

When printing is completed and the fixing device 20 enters the standby state, the driving speed of the fixing belt 21 is reduced along with a decrease in a rotation speed of the fixing auxiliary roller 22. In the first example embodiment, the driving speed of the fixing belt 21 during standby is reduced to one-third a normal driving speed thereof during printing. At this time, when the surface temperature of the fixing belt 21 is higher than the desired temperature during standby, the heater 25 is turned off. On the other hand, when the surface temperature of the fixing belt 21 is lower than the desired temperature during standby, the heater 25 is turned on. The driving of the fixing belt 21 is stopped after the fixing belt 21 has been idled at the lower speed for a predetermined time, for example, 5 seconds.

By performing such a control operation, a temperature difference between an inner circumferential surface of the heat roller 23 and the surface of the fixing belt 21 decreases. Moreover, the fixing belt 21 has a smaller temperature distribution in a circumferential direction, preventing temperature overshoot.

Figure 4:
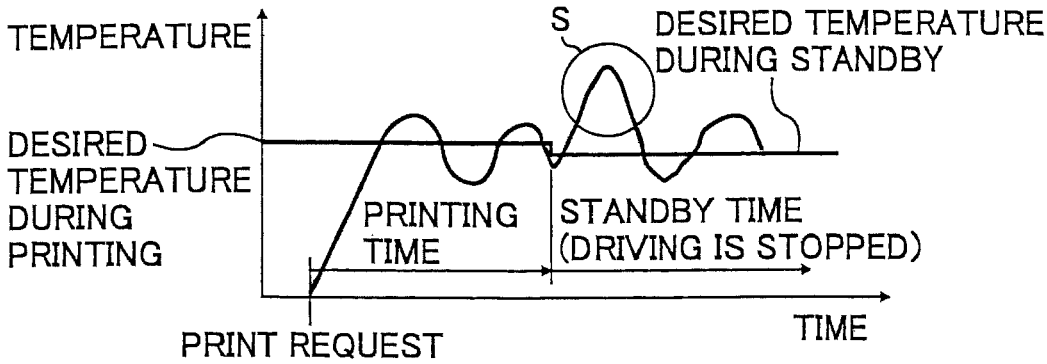
FIG. 4 PRIOR ART
FIG. 4 is a graph illustrating a temperature change in a related-art fixing member.

FIG. 4 is a graph illustrating a temperature change in a related-art fixing device. In the related-art fixing device, the driving of the fixing belt 21 is promptly stopped when printing is completed, after which the fixing device 20 enters the standby state. As a result, temperature overshoot occurs at an early stage of the waiting time (a portion S, for example, 230° C., in FIG. 4), caused by a relatively large difference in temperature between the inner circumferential surface of the heat roller 23 provided facing the heater 25 and the surface of the fixing belt 21, as shown in FIG. 5.

Figure 5:
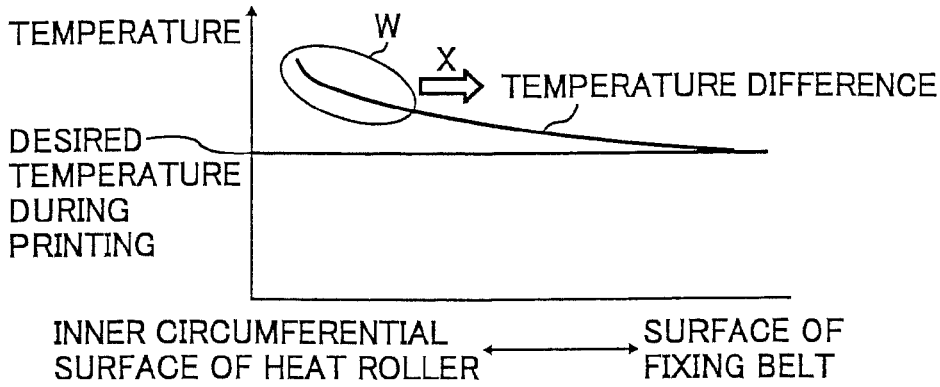
FIG. 5 PRIOR ART
FIG. 5 is a graph illustrating a temperature difference between an inner circumferential surface of a heat roller and a surface of a fixing belt.

Specifically, when the driving of the fixing belt 21 is stopped immediately after printing has been completed, then the fixing device 20 enters the standby state and heat of the heat roller 23 is transferred to the fixing belt 21 (heat shown at a portion W moves in a direction indicated by an arrow X in FIG. 5) to maintain heat balance due to a small heat capacity of the fixing belt 21. As a result, there is an excessive increase in temperature of the fixing belt 21 at a portion heated by the heat roller 23. Furthermore, the fixing belt 21 has a larger temperature distribution in a circumferential direction in which the portion heated by the heat roller 23 has the highest temperature.

On the other hand, in the first example embodiment, the fixing belt 21 is driven at the lower speed for a predetermined time when the fixing device 20 enters the standby state, so that the heat from the heat roller 23 is evenly spread in the circumferential direction in the fixing belt 21. Therefore, a temperature change in the surface of the fixing belt 21 is relatively small when the fixing device 20 enters the standby state and the fixing belt 21 is driven at the lower speed, as shown in FIG. 3. As a result, temperature overshoot can be prevented. Moreover, since the heat of the fixing belt 21 is not transferred to the recording medium P after printing has been completed, the amount of time the heater 25 remains on decreases. Therefore, temperature distribution in the circumferential direction in the fixing belt 21 is relatively limited.

Figure 3:
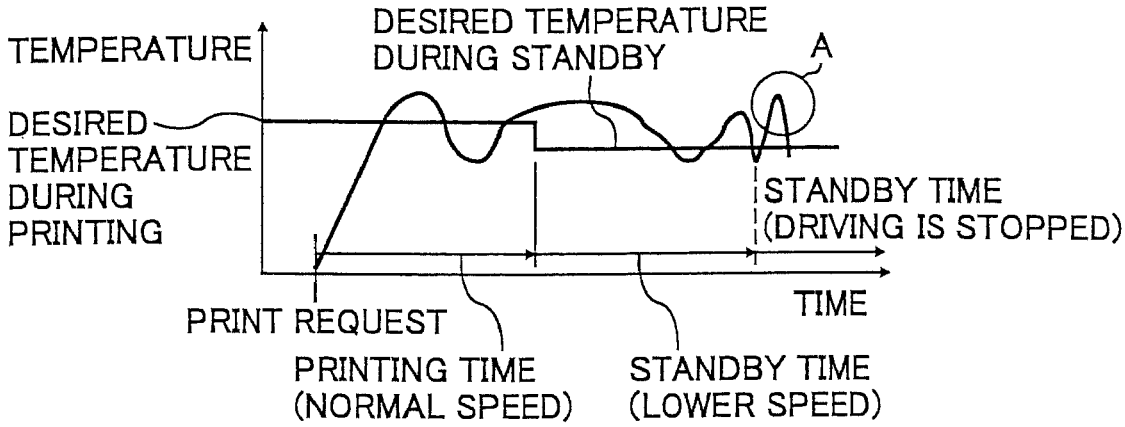
FIG. 3 is a graph illustrating a temperature change in a fixing member when the fixing device performs a control operation according to a first example embodiment.

When the driving of the fixing belt 21 is stopped after the fixing belt 21 has been driven at the lower speed, the temperature of the fixing belt 21 slightly increases as indicated by a portion A, for example, 170° C., in FIG. 3 due to the heat transferred from the heat roller 23. However, the increased temperature of the fixing belt 21 is not very different from the desired temperature during standby and the desired temperature during printing.

Thus, in the first example embodiment, the driving of the fixing belt 21 is stopped after the driving speed of the fixing belt 21 has been reduced during standby as described above. As a result, temperature overshoot in the fixing belt 21 can be prevented after printing has been completed. Moreover, a long life of the components of the fixing device 20 can be achieved as compared to a case in which the driving of the fixing belt 21 is stopped immediately after the fixing belt 21 has been driven at a normal speed.

The pressing roller 31 is used as a pressing member in the first example embodiment. Alternatively, however, a pressing belt or a pressing pad may also be used as the pressing member in place of the pressing roller 31. In addition, the first example embodiment may be applied to a fixing device in which a plurality of nip portions is formed in a direction in which a recording medium is conveyed. An effect similar to that obtained in the first example embodiment can be achieved in the above-described alternative cases.

Also, the fixing belt 21 is tightly stretched across the two rollers, the fixing auxiliary roller 22 and the heat roller 23, in the first example embodiment. Alternatively, the fixing belt 21 may be tightly stretched across three or more rollers. In addition, although the heat roller 23 is heated by the heater 25 in the first example embodiment, the heater roller 23 may also be electromagnetically heated by an exciting coil. An effect similar to that obtained in the first example embodiment can be achieved in the above-described alternative cases.

A description is now given of a second example embodiment of the present invention.

Figure 6:
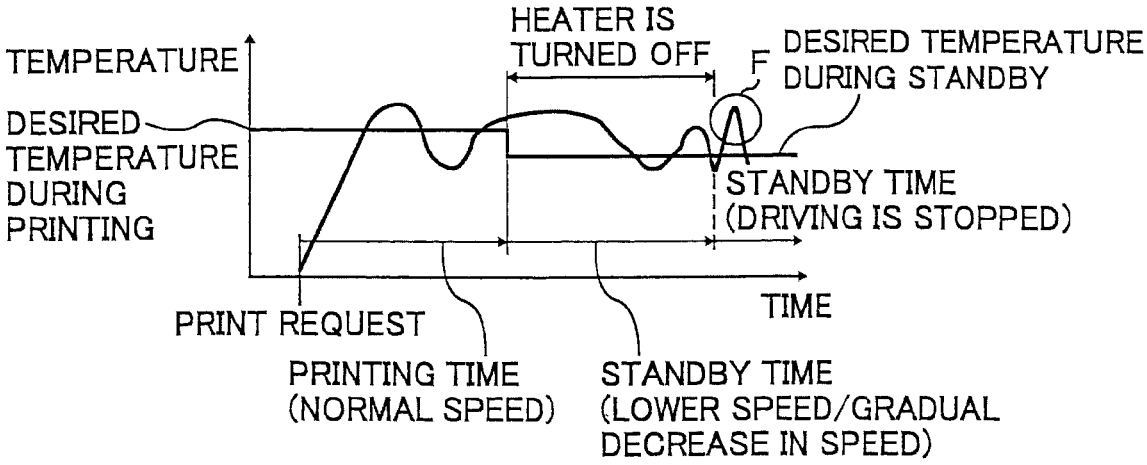
FIG. 6 is a graph illustrating a temperature change in the fixing member when the fixing device performs a control operation according to a second example embodiment.

FIG. 6 is a graph illustrating a temperature change in the fixing belt 21 when a control operation according to the second example embodiment is performed by the fixing device 20. FIG. 6 corresponds to FIG. 3 in the first example embodiment.

In the second example embodiment as well as the first example embodiment, the fixing belt 21 is idled at a lower speed for a predetermined time, for example, 5 seconds, during standby after printing has been completed, then the driving of the fixing belt 21 is stopped. However, the driving speed of the fixing belt 21 is reduced in multiple steps after printing has been completed in the second example embodiment. Specifically, the driving speed of the fixing belt 21 immediately after printing has been completed is reduced to one-half a normal driving speed during printing. Thereafter, the driving speed of the fixing belt 21 is gradually reduced to one-third, one-quarter, and so on, of the normal driving speed. Eventually, the driving of the fixing belt 21 is stopped.

By performing the above-described control operation, temperature overshoot in the fixing belt 21 can be reliably prevented even in a high-speed image forming apparatus in which the recording medium P is conveyed at a higher speed so that a large amount of heat is transferred from the fixing belt 21 to the recording medium P.

Specifically, when the fixing belt 21 is driven at a higher speed, a temperature overshoot occurs when the driving speed of the fixing belt 21 is largely reduced, that is, at a time, for example, when the driving speed is at once reduced to one-quarter of the normal driving speed. On the other hand, in the second example embodiment, the driving speed of the fixing belt 21 is reduced gradually after printing has been completed. Accordingly, the temperature difference between the inner circumferential surface of the heat roller 23 and the surface of the fixing belt 21 gradually decreases, preventing temperature overshoot.

Moreover, in the second example embodiment, the heater 25 stops heating the fixing belt 21 while the driving speed of the fixing belt 21 is being reduced after printing has been completed. In other words, even if the surface temperature of the fixing belt 21 is lower than the desired temperature during standby, the heater 25 is turned off when the fixing belt 21 is driven at a lower speed during standby. By performing such a control operation, temperature overshoot can be reliably prevented even when the heat roller 23 and the fixing belt 21 have a smaller heat conductivity so that the heat of the inner circumferential surface of the heat roller 23 is transferred to the surface of the fixing belt 21 at a lower speed. Particularly, when the heat roller 23 and the fixing belt 21 have a smaller heat conductivity, the temperature difference therebetween may increase even if the surface temperature of the fixing belt 21 is not much reduced by the reduction of the driving speed of the fixing belt 21.

Specifically, when the surface temperature of the fixing belt 21 at a portion detected by the temperature sensor 40 falls below the desired temperature while the fixing belt 21 is idled at a lower speed after printing has been completed, the heater 25 starts heating the heating roller 23. However, the heater 25 may heat the heat roller 23 more than necessary due to a delay in a response to the detection of the temperature. As a result, a difference in a temperature between the inner circumferential surface of the heat roller 23 and the surface of the fixing belt 21 may increase, resulting in temperature overshoot.

On the other hand, in the second example embodiment, the heater 25 is turned off when the fixing belt 21 is driven at a lower speed during standby even if the surface temperature of the fixing belt 21 is lower than the desired temperature during standby, so that the heater 25 does not heat the heat roller 23. Therefore, a temperature from the inner circumferential surface of the heat roller 23 to the surface of the fixing belt 21 is promptly balanced. As a result, although the temperature of the fixing belt 21 slightly increases as indicated by a portion F in FIG. 6 when the driving of the fixing belt 21 is stopped after the fixing belt 21 has been driven at the lower speed, the increased temperature of the fixing belt 21 is not very different from the desired temperature during standby, preventing temperature overshoot.

A description is now given of a third example embodiment of the present invention.

Figure 7:
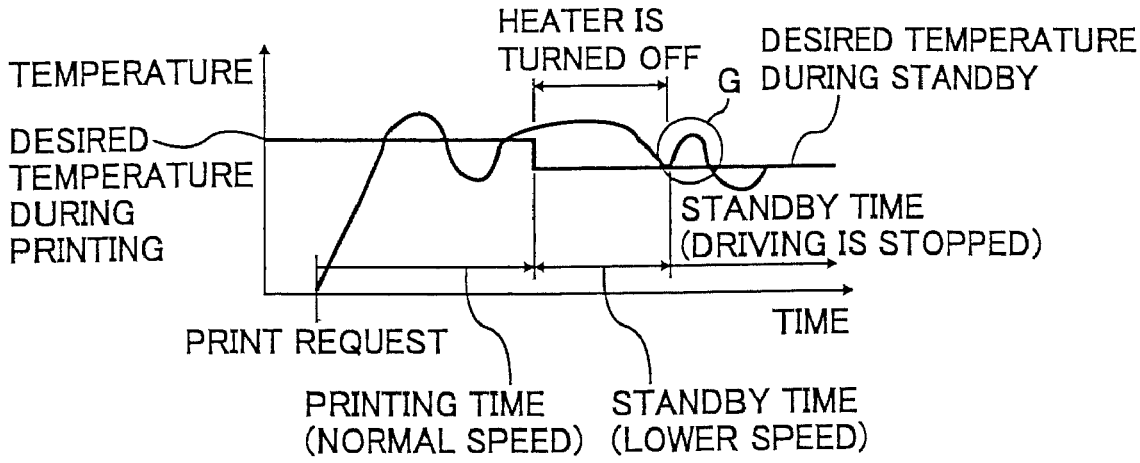
FIG. 7 is a graph illustrating a temperature change in the fixing member when the fixing device performs a control operation according to a third example embodiment.

FIG. 7 is a graph illustrating a temperature change in the fixing belt 21 when a control operation according to the third example embodiment is performed by the fixing device 20. FIG. 7 corresponds to FIG. 3 in the first example embodiment.

In the third example embodiment as well as the first and second embodiments described above, the fixing belt 21 is idled at a lower speed during standby after printing has been completed, after which the driving of the fixing belt 21 is stopped. In the third example embodiment as well as the second example embodiment, the heater 25 is turned off when the fixing belt 21 is driven at a lower speed during standby.

Referring to FIG. 7, the driving speed of the fixing belt 21 is reduced after printing has been completed, and then the driving of the fixing belt 21 is stopped when the temperature detected by the temperature sensor 40 reaches a desired temperature during standby. In other words, the driving of the fixing belt 21 at a lower speed is stopped when the surface temperature of the fixing belt 21 reaches the desired temperature during standby.

Ordinarily, when the fixing belt 21 is driven at a lower speed for a long time while the heater 25 is turned off, a temperature detected by the temperature sensor 40 falls sharply below the desired temperature during standby. However, by performing the above-described control operation, temperature overshoot caused by a rapid temperature increase due to a temperature control performed immediately after the detection of the temperature can be reliably prevented.

Specifically, in the third example embodiment, the fixing belt 21 is driven at a lower speed during standby until the temperature of the fixing belt 21 reaches the desired temperature during standby. Therefore, the temperature of the fixing belt 21 at the time when the driving of the fixing belt 21 is stopped is substantially equal to the desired temperature during standby as indicated by a portion G in FIG. 7, preventing temperature overshoot.

A description is now given of a fourth example embodiment of the present invention.

Figure 8:
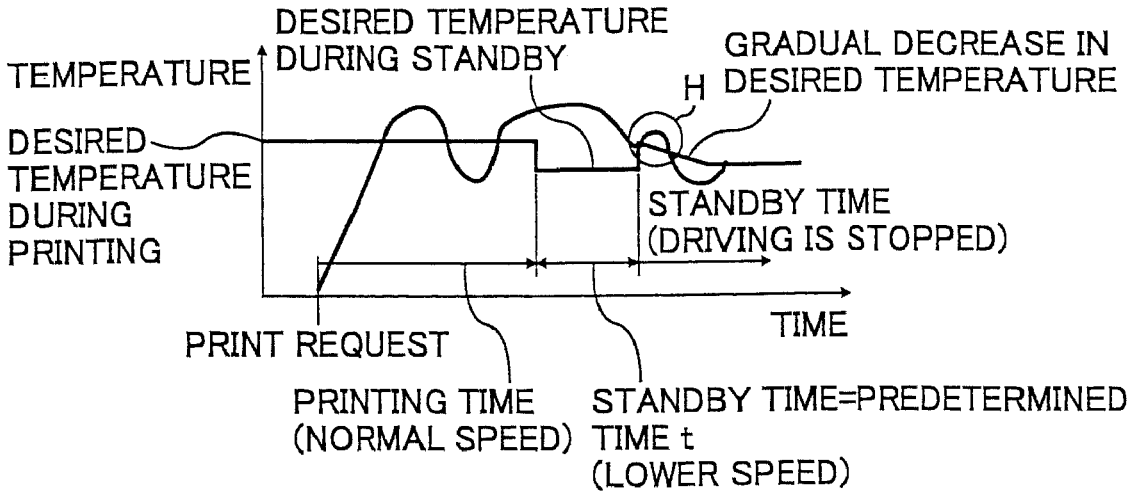
FIG. 8 is a graph illustrating a temperature change in the fixing member when the fixing device performs a control operation according to a fourth example embodiment.

FIG. 8 is a graph illustrating a temperature change in the fixing belt 21 when a control operation according to the fourth example embodiment is performed by the fixing device 20. FIG. 8 corresponds to FIG. 3 in the first example embodiment.

In the fourth example embodiment as well as the first through third embodiments described above, the fixing belt 21 is idled at a lower speed for a predetermined time during standby after printing has been completed, after which the driving of the fixing belt 21 is stopped. Referring to FIG. 8, the driving of the fixing belt 21 is stopped after the fixing belt 21 has been driven at a lower speed for a predetermined time t, for example, 5 seconds. A temperature detected by the temperature sensor 40 when the driving of the fixing belt 21 is stopped is set as an initial value of a desired temperature during standby after the driving of the fixing belt 21 has been stopped. Thereafter, the desired temperature is controlled such that the initial temperature is gradually reduced to a reference temperature that is set in the apparatus in advance. In other words, the driving of the fixing belt 21 is stopped after the fixing belt 21 has been driven at a lower speed for a relatively short time, and the desired temperature is temporarily set to the temperature detected by the temperature sensor 40 when the driving of the fixing belt 21 is stopped. Thereafter, the desired temperature is gradually reduced to the reference temperature.

According to the fourth example embodiment, the useful life of the components of the fixing device 20 is much more lengthened when there is a large difference between the surface temperature of the fixing belt 21 after printing has been completed and the desired temperature during standby. In this case, according to the third example embodiment, the fixing belt 21 may be required to be driven at a lower speed for a long time. By repeatedly performing such a temperature control operation, an accumulated time in which the fixing belt 21 is driven at a lower speed may lengthen. On the other hand, according to the fourth example embodiment, the fixing belt 21 is not required to be driven at such a lower speed for a long time, resulting in lengthening the useful life of the components of the fixing device 20.

Specifically, since the fixing belt 21 is driven at a lower speed for the predetermined time t during standby in the fourth example embodiment, the fixing device 20 is not unnecessarily idled for a long time, preventing a short life of the components of the fixing device 20. In addition, even if the temperature detected by the temperature sensor 40 is largely lower than the reference value for the desired temperature when the driving of the fixing belt 21 is stopped after the fixing belt 21 has been driven at a lower speed for the predetermined time t, the detected temperature is temporarily set as the initial value of the desired temperature during standby after the driving of the fixing belt 21 has been stopped. As a result, a difference between the temperature detected by the temperature sensor 40 and the desired temperature is apparently eliminated as indicated by a portion H in FIG. 8. Thus, temperature overshoot caused by a rapid temperature increase due to the temperature control operation performed immediately after the detection of the temperature can be prevented.

When the surface temperature of the fixing belt 21 during standby after the driving of the fixing belt 21 has been stopped is lower than the reference value, it takes a longer time to start the next printing. On the other hand, when the surface temperature of the fixing belt 21 during standby after the driving of the fixing belt 21 has been stopped is higher than the reference value, the fixing device 20 overheats, causing failure of the temperature sensor 40 and other components of the fixing device 20.

To solve the above-described problems, in the fourth example embodiment, the desired temperature of the fixing belt 21 during standby is gradually changed from the initial value to the reference value, so that a difference between the desired temperature and an actual temperature can be kept small. Accordingly, temperature overshoot of the fixing belt 21 can be prevented after printing has been completed, without shortening a life of the components of the fixing device 20.

Example embodiments are not limited to the details described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. A fixing device, comprising:

a fixing member to melt a toner so as to fix a toner image onto a recording medium;

a temperature sensor to detect a temperature of the fixing member; and a heater to heat the fixing member based on the temperature detected by the temperature sensor, wherein a driving speed of the fixing member is reduced to a constant driving speed after printing is completed, and the fixing member stops driving directly following an elapsed time at the constant driving speed.

2. The fixing device according to claim 1, wherein the fixing member is not heated by the heater while driving at the constant driving speed.

3. The fixing device according to claim 1, wherein the fixing member includes a fixing belt stretched across a plurality of rollers, and the heater heats at least one roller among the plurality of the rollers.

4. The fixing device according to claim 1, wherein the fixing member is driven for a predetermined time at the constant driving speed.

5. The fixing device according to claim 1, wherein the temperature of the fixing member is controlled to have a desired temperature (Ts) in a standby state after driving is stopped.

6. The fixing device according to claim 5, wherein the heater is turned on and off based on the detected temperature to give the fixing member the desired temperature (Ts).

7. The fixing device according to claim 6, wherein the desired temperature (Ts) is lower than a desired temperature (Tp) during printing.

8. An image forming apparatus, comprising:

an image bearing member configured to bear an electrostatic latent image;

a charging device configured to charge a surface of the image bearing member;

an irradiating device configured to irradiate the charged surface of the image bearing member to form an electrostatic latent image thereon;

a developing device configured to develop the electrostatic latent image with a toner to form a toner image;

a transfer device configured to transfer the toner image onto a recording medium; and a fixing device configured to fix the toner image onto the recording medium, the fixing device includes, a fixing belt configured to contact the toner image so as to fix the toner image onto the recording medium;

a temperature sensor configured to detect a temperature of the fixing belt; and a heater configured to heat the fixing belt based on the temperature detected by the temperature sensor, wherein a driving speed of the fixing belt is reduced to a constant driving speed after printing is completed, and the fixing belt stops driving directly following an elapsed time at the constant driving a speed.

9. The image forming apparatus according to claim 8, wherein the fixing belt is not heated by the heater while driving at the constant driving speed.

10. The image forming apparatus according to claim 8, wherein the fixing belt is driven for a predetermined time at the constant driving speed.

11. The image forming apparatus according to claim 8, wherein the temperature of the fixing belt is controlled to have a desired temperature (Ts) in a standby state after driving is stopped.

12. The image forming apparatus according to claim 11, wherein the heater is turned on and off based on the detected temperature to give the fixing belt the desired temperature (Ts).

13. The image forming apparatus according to claim 12, wherein the desired temperature (Ts) is lower than a desired temperature (Tp) during printing.

14. A fixing device, comprising:

a fixing belt;

a pressure roller configured to contact the fixing belt; and a heater configured to heat the fixing belt, wherein a driving speed of the fixing belt is reduced to a constant driving speed after printing is completed, and the fixing belt stops driving directly following a predetermined time at the constant driving speed.

15. The fixing device according to claim 14, further comprising a plurality of rollers inside the fixing belt, wherein the fixing belt is tightly stretched across the plurality of rollers.

16. The fixing device according to claim 14, wherein the fixing belt is not heated by the heater while driving at the constant driving speed.

17. The fixing device according to claim 14, wherein the temperature of the fixing belt is controlled to have a desired temperature (Ts) in a standby state after driving is stopped.

18. The fixing device according to claim 17, wherein the heater is turned on and off on a detected temperature to give the fixing belt the desired temperature (Ts).

19. An image forming apparatus, comprising the fixing device according to claim 14.

* * * * *